US005537844A

United States Patent [19]

MacLean

[11] Patent Number: 5,537,844

[45] Date of Patent: Jul. 23, 1996

[54] KNITTING STITCH HOLDER ASSEMBLY WITH DETACHABLE OPPOSITE END RETAINERS

[76] Inventor: Torry F. MacLean, P.O. Box 512, Trona, Calif. 93592

[21] Appl. No.: 373,418

[22] Filed: Jan. 17, 1995

[51] Int. Cl.[6] ..... D04B 35/02; A41F 1/00

[52] U.S. Cl. ..... 66/117; 66/1 A; 24/662; 24/676

[58] Field of Search ..... 66/1 A, 117; 24/662, 24/673, 674, 676, 707.2

[56] References Cited

U.S. PATENT DOCUMENTS

| | | | |
|---|---|---|---|
| 1,183,250 | 5/1916 | Smith | 66/117 |
| 1,236,116 | 8/1917 | Smith | 24/673 X |
| 1,238,639 | 8/1917 | Collins | 24/707.2 X |
| 1,261,853 | 4/1918 | Reece | 66/117 |
| 1,523,918 | 1/1925 | Traum | 66/117 |
| 2,040,289 | 5/1936 | Adams | 66/117 |
| 2,090,807 | 8/1937 | Phillips | 66/117 |
| 2,133,431 | 10/1938 | Craft | 66/117 |
| 2,718,131 | 9/1955 | Black et al. | 66/117 |
| 2,762,083 | 9/1956 | Noguera | 24/676 X |
| 2,887,858 | 5/1959 | Sanders | 66/117 |
| 2,930,213 | 3/1960 | Sorlie | 66/1 |
| 4,138,864 | 2/1979 | Bennett | 66/117 |

FOREIGN PATENT DOCUMENTS

| | | | |
|---|---|---|---|
| 746807 | 6/1933 | France | 66/117 |
| 925284 | 8/1947 | France | 24/662 |
| 979076 | 4/1951 | France | 66/117 |
| 1212630 | 3/1960 | France | 24/673 |
| 171069 | 4/1952 | Germany . | |
| 392013 | 5/1933 | United Kingdom . | |
| 392014 | 5/1933 | United Kingdom | 66/117 |
| 547550 | 9/1942 | United Kingdom | 66/117 |
| 825647 | 12/1959 | United Kingdom | 66/117 |
| 1044489 | 9/1966 | United Kingdom | 24/673 |
| 393410 | 6/1993 | United Kingdom | 66/117 |

*Primary Examiner*—John J. Calvert
*Attorney, Agent, or Firm*—John R. Flanagan

[57] ABSTRACT

A knitting stitch holder assembly includes an elongated rod for holding stitches and a pair of detachable end retainers that prevent the stitches from inadvertently slipping off the ends of the rod. Formed about and in each of the opposite ends of the rod is an annular groove. The end retainers include resilient yieldable elements, such as detents or tabs, that extend within and engage the grooves to detachably secure the retainers on the opposite ends of the rod. Since both end retainers are detachable, stitches may be removed from either of the opposite ends of the elongated rod.

15 Claims, 1 Drawing Sheet

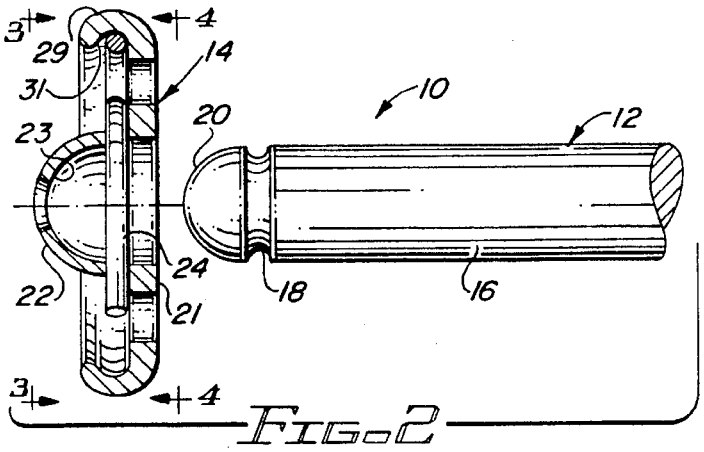
FIG. 2
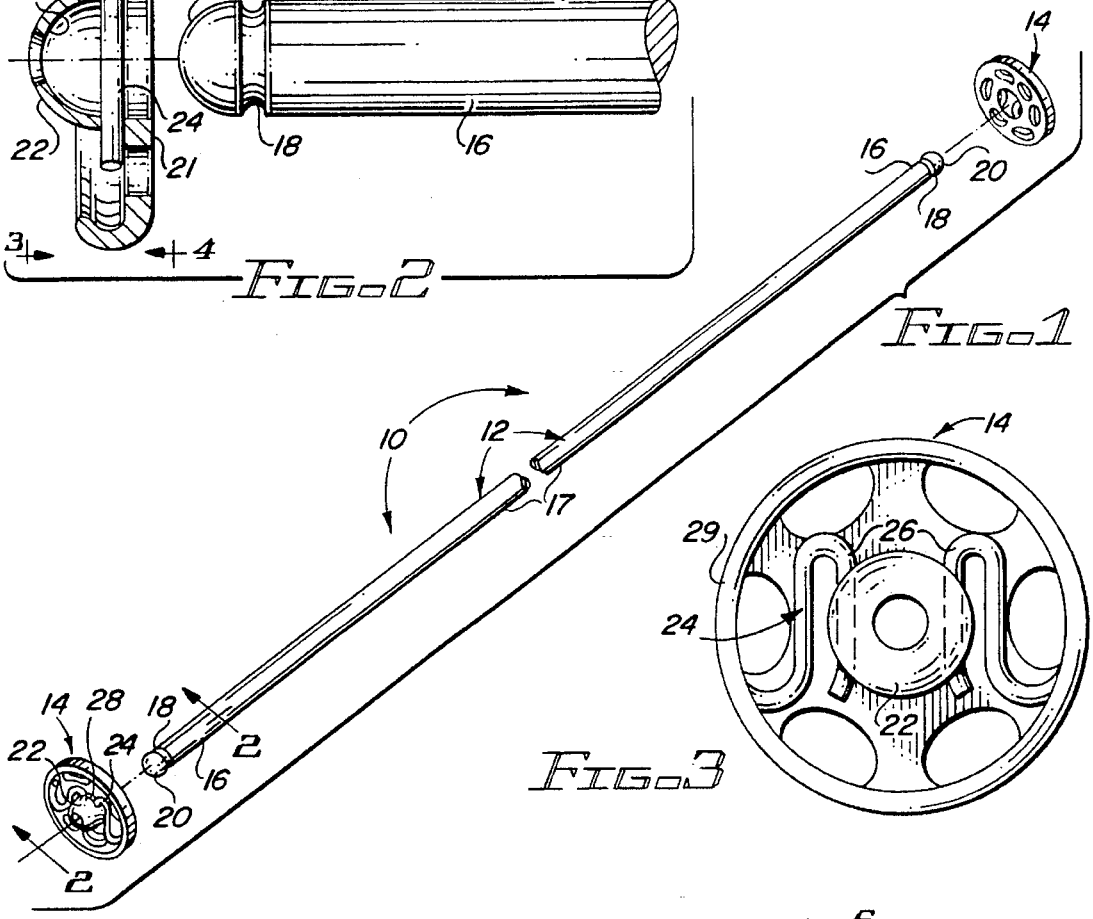
FIG. 1
FIG. 3
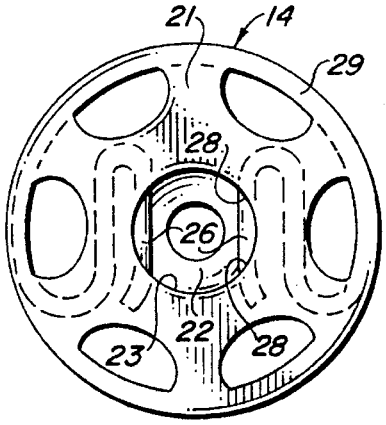
FIG. 4
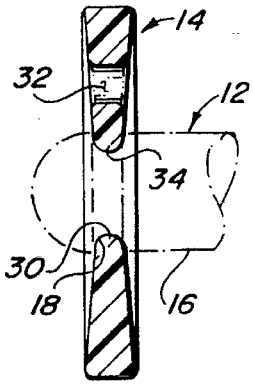
FIG. 6
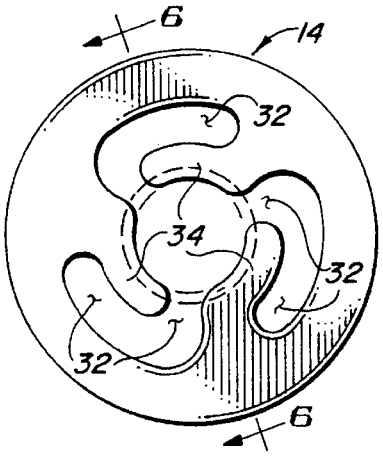
FIG. 5

KNITTING STITCH HOLDER ASSEMBLY WITH DETACHABLE OPPOSITE END RETAINERS

BACKGROUND OF THE INVENTION

1. Field of the Invention

The present invention generally relates to devices used for knitting and, more particularly, is concerned with a knitting stitch holder assembly having detachable end retainers to allow for removal of stitches from either end of the stitch holder.

2. Description of the Prior Art

When knitting, it is often expedient to place a number of stitches on a stitch holder while knitting additional stitches. Stitch holders that have detachable retaining means which prevent the stitches from inadvertently slipping off the holder are preferable to those that have no retaining means. Several stitch holder devices exist which incorporate such means. One device combines a knitting needle and a stitch holder by including a casing which fits over a shoulder at one end of a needle and a bail attached to the casing which ends in a cone that may be fitted over the pointed end of the needle to prevent stitches held on the needle from slipping off the needle. Such a device is disclosed in U.S. Pat. No. 2,718131 to Black et al. Another device includes an elongated shank which tapers to a blunt point at one end and is formed in a loop at the opposite end which prevents the stitches from accidently sliding off the end of the holder. This type of device is disclosed in U.S. Pat. No. 4,138,864 to Bennett. However, like several stitch holding devices, the above two stitch holder devices present the disadvantage of only allowing the stitches to be removed from one end of the device.

Stitch holders that allow for removal of the stitches from either end of the holder have a significant advantage over stitch holders that only accommodate removal from one end of the holder. Two-way stitch removal is a beneficial feature because it affords access to either end of the group of stitches and eliminates the need to reverse the order of the stitches on the holder by transferring the stitches off the holder and onto another holder or onto the original holder. Several stitch holder devices combine retaining means with two-way removal capability. One device includes a U-shaped member having leg portions formed with bifurcated elements for receiving opposite ends of a needle, either of which may be released from the U-shaped member to allow for two-way removal of stitches. U.S. Pat. No. 2,930,213 discloses this type of device. This type of stitch holder is more cumbersome than necessary because it includes a rather large U-shaped member in addition to the needle which holds the stitches. Simpler than the prior device are those which include a needle and a pair of removable knobs that fit over the ends of the needle. Examples of such devices are disclosed in United Kingdom Pat. Nos. 392,013 and 392,014 to Shepard and in United Kingdom Pat. No. 825,647 to Vale. While these devices combine simplicity, retaining means and two-way stitch removal, the frictional means by which the knobs are held on the end of the needle are not entirely reliable.

Consequently, a need still exists for a knitting stitch holder device that is simple, allows for two-way stitch removal, and includes detachable retaining means that are reliably held on the ends of the holder.

SUMMARY OF THE INVENTION

The present invention provides a knitting stitch holder assembly with detachable opposite end retainers designed to satisfy the aforementioned needs. The knitting stitch holder assembly of the present invention includes an elongated rod for holding stitches, a pair of annular grooves formed in and about the rod near either end of the rod, and a pair of detachable end retainers that detachably interfit with the annular grooves.

One feature of the present invention is that it includes end retainers that are detachable from either end of the elongated rod. The end retainers prevent stitches placed on the rod from inadvertently slipping off the holding rod. Since both of the retainers are detachable, stitches may be placed on the holder from either end of the rod and may be removed from either end of the rod.

Another feature of the knitting stitch holder assembly of the present invention is that the end retainers are reliably held on the ends of the rod. The end retainers interfit with the annular grooves to secure the retainers on the rod making it difficult for the retainers to become dislodged from the ends of the rod.

Accordingly, the present invention is directed to a knitting stitch holder assembly which comprises: (a) an elongated rod for holding stitches and having a pair of opposite end portions; and (b) a pair of detachable end retainers that prevent the stitches from inadvertently slipping off the ends of the rod. Formed about and in each of the opposite end portions of the rod is an annular groove. The end retainers include resilient yieldable elements, such as detents or tabs, that interfit with and engage the grooves to detachably secure the end retainers on the opposite ends of the rod. Since both end retainers are detachable, stitches may be removed from either of the opposite ends of the elongated rod.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which:

FIG. 1 is a perspective view of a knitting stitch holder assembly of the present invention showing an elongated rod with a pair of detachable end retainers.

FIG. 2 is an enlarged view of one of the detachable end retainers shown in cross-section and of one end of the elongated rod of the assembly taken along line 2—2 in FIG. 1.

FIG. 3 is an outer side elevational view of one detachable end retainer of the assembly as seen along line 3—3 of FIG. 2.

FIG. 4. is an inner side elevational view of one detachable end retainer of the assembly as seen along line 4—4 of FIG. 2.

FIG. 5. is a side elevational view of an alternative embodiment of the detachable end retainer of the assembly.

FIG. 6 is a cross-sectional view of the alternative embodiment of the detachable end retainer taken along line 6—6 in FIG. 5.

DETAILED DESCRIPTION OF THE INVENTION

Referring to the drawings and particularly to FIGS. 1 and 2, there is illustrated a knitting stitch holder assembly of the present invention, generally designated 10. The knitting stitch holder assembly 10 basically includes an elongated rod 12 and a pair of detachable end retainers 14. The rod 12, which preferably is rigid and made of anodized aluminum; and, includes a pair of identical opposite end portions 16 and a main portion 17, being shown in foreshortened form in FIG. 1, extending between and interconnecting the opposite end portions 16. The end retainers 14 are generally disc-shaped and preferably identical to one another.

The assembly 10 also includes a pair of annular grooves 18 defined in the rod 12 and extending about the opposite end portions 16 thereof. The grooves 18 are formed at locations spaced inwardly short distances from terminal ends 20 of the opposite end portions 16 of the rod 12. Although they may be shaped differently, in the preferred embodiment the terminal ends 20 of the rod 12 are rounded and blunt. As clearly shown in FIGS. 1 and 2, the main portion 17 and opposite end portions 16 of the rod 12 extending between the opposite annular grooves 18 therein have the same cross-sectional size. Also, as clearly seen in FIG. 2, the respective rounded terminal ends 20 of the rod 12 having cross-sectional sizes which at a maximum are the same as the cross-sectional size of the opposite end portions 16 and the main portion 17 of the rod 12.

Referring now to FIGS. 2–4, there is illustrated one preferred embodiment of the detachable end retainers 14 of the assembly 10 of the present invention. Each of the detachable end retainers 14 includes a disc-shaped body 21 and a central dimple 22 attached to the body 21 and forming a recess 23 for receiving either one of the terminal ends 20 of the rod 12. Each end retainer 14 includes a C-shaped spring member 24 having a pair of opposing facing parts being generally U-shaped and defining a pair of detents 26 extending into the recess 23 through a pair of slots 28 defined in opposite portions of the dimple 22. The detents 26 flex or move radially outward as the terminal end 20 of the rod 12 is inserted into the dimple 22. When the terminal end 20 is fully inserted into the dimple 22, the detents 26 return radially inward to interfit with and engage the annular groove 18 thereby detachably securing the end retainer 14 on the end portion 16 of the rod 12. Also, each end retainer 14 includes a peripheral rim 29 defining an annular channel 31 on an interior side thereof for receiving and seating the spring member 24 therein.

Referring now to FIGS. 5 and 6, there is shown an alternative embodiment of each of the end retainers 14 of the assembly 10 of the present invention. The disc-shaped body 21 of each end retainer 14 is centrally formed with a circular hole 30 through which either terminal end 20 of the rod 12 may be inserted. Also, extending radially outward from the circular hole 30 are a plurality of arcuate slots 32 open at inner ends with the central hole 30 and extending radially outward and then circumferentially about the central hole 30 so as to defined a plurality of arcuate tabs 34. The tabs 34 can flex outward as one of the terminal ends 20 of the rod 12 is inserted through the central hole 30. When the terminal end 20 is inserted far enough, the tabs 34 return inward to interfit with and engage the respective annular groove 18 thereby detachably securing the end retainer 14 on the respective one of the end portions 16 of the rod 12.

In summary, the pair of detachable end retainers 14 prevent stitches from inadvertently slipping off the opposite terminal ends 20 of the rod 12. The end retainers 14 have resilient yieldable elements, such as detents 26 or tabs 34, that extend within and engage the grooves 18 to detachably secure the end retainers 14 on the opposite end portions 16 of the rod 12. The detents 26 or tabs 34 are capable of resilient flexing to allow engagement with and disengagement from the respective annular groove 18 as a respective one of the opposite end portions 16 of the rod 12 is pushed and pulled into and from the central recess or hole of the end retainer. Since both end retainers 14 are detachable, stitches may be removed from either of the opposite terminal ends 20 of the elongated rod 12.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A knitting stitch holder assembly, comprising:

(a) an elongated rod for holding stitches, said rod having a pair of opposite end portions, a main portion extending between said opposite end portions, a pair of terminal ends at opposite outer ends of said outer end portions being rounded and blunt, and a pair of annular grooves each formed about and in one of said opposite end portions of said rod adjacent to said respective terminal ends, said opposite end portions and said main portion extending between said annular grooves and having the same cross-sectional size, said respective rounded terminal ends of said rod having a cross-sectional size at a maximum being the same as the cross-sectional size of said opposite end portions and said main portion of said rod; and (b) a pair of end retainers each having means for detachably interfitting with a respective one of said pair of annular grooves in said opposite end portions of said rod to detachably secure said end retainers on said respective opposite end portions of said rod to prevent the stitches from inadvertently slipping off said rod, said means for detachably interfitting being a resilient yieldable element for extending within and engaging with one of said grooves to detachably secure said end retainers on said respective opposite end portions of said rod.

2. The assembly of claim 1 wherein each of said end retainers is disc-shaped and has a central dimple with a recess defined therein.

3. The assembly of claim 2 wherein said interfitting means of each of said end retainers includes a C-shaped spring member having a pair of opposing facing parts defining a pair of detent elements extending into said recess through slots defined in opposite portions of said dimple of each one of said end retainers.

4. The assembly of claim 3 wherein each of said end retainers includes a peripheral rim defining an annular channel on an interior side thereof for receiving and seating said C-shaped spring member therein.

5. The assembly of claim 1 wherein said interfitting means of each of said end retainers includes a plurality of arcuate slots formed in said end retainer, said slots at inner ends being open at a central hole defined through said end retainer and enclosed at outer ends spaced from said central hole, said slots extending radially outward from said inner ends and circumferentially about said central hole to said outer ends such that each of said end retainers is formed with a plurality of resilient arcuate tabs that are engageable with a respective one of said annular grooves to detachably secure said end retainers on said opposite end portions of said rod and that are capable of flexing to allow engagement with and disengagement from said annular groove as a respective one of said opposite end portions of said rod is pushed and pulled into and from said central hole.

6. A knitting stitch holder assembly, comprising:

(a) an elongated rod including a pair of opposite end portions, a main portion extending between said opposite end portions, and a pair of terminal ends at the outer ends of said outer end portions being rounded and blunt;

(b) means defining a pair of annular grooves in said rod about said opposite end portions, said grooves being located adjacent to and inward from said terminal ends of said outer end portions, said opposite end portions and said main portion extending between said opposite annular grooves having the same cross-sectional size, said cross-sectional size of said respective rounded terminal ends of said rod at a maximum being the same as said cross-sectional size of said opposite end portions and said main portion of said rod; and (c) a pair of end retainers each having a central dimple defining a recess with respect to which said terminal end of one of said end portions of said rod may be pushed and pulled to respectively insert and withdraw said end portion of said rod into and from said respective one end retainer, each of said end retainers including means for detachably interfitting with a respective one of said pair of annular grooves in said opposite end portions of said rod to detachably secure said end retainers on said respective opposite end portions of said rod to prevent the stitches from inadvertently slipping off said rod, said means for detachably interfitting being a resilient yieldable element for extending within and engaging with one of said grooves to detachably secure said end retainers on said respective opposite end portions of said rod.

7. The assembly of claim 6 wherein said retainers are disc-shaped.

8. The assembly of claim 6 wherein said resilient yieldable element of each of said end retainers is a C-shaped spring member having a pair of opposing facing parts defining a pair of detents extending into said recess through respective slots defined in opposite portions of said dimple of each one of said end retainers.

9. The assembly of claim 8 wherein each of said end retainers includes a peripheral rim defining an annular channel on an interior side thereof for receiving and seating said C-shaped spring member therein.

10. The assembly of claim 6 wherein said elongated rod is made from anodized aluminum.

11. A knitting stitch holder assembly, comprising:

(a) an elongated rod including a pair of opposite end portions, a main portion extending between said opposite end portions, and a pair of terminal ends at the outer ends of said outer end portions being rounded and blunt;

(b) means defining a pair of annular grooves in said rod about said opposite end portions, said grooves being located adjacent to and inward from said terminal ends of said outer end portions, said opposite end portions and said main portion extending between said opposite annular grooves having the same cross-sectional size, said cross-sectional size of said respective rounded terminal ends of said rod at a maximum being the same as said cross-sectional size of said opposite end portions and said main portion of said rod; and (c) a pair of end retainers each having a central hole through which said terminal end of one of said end portions of said rod may be pushed and pulled to insert and withdraw said end portion of said rod into and from said end retainer, each of said end retainers including means for detachably interfitting with said annular groove to detachably secure said end retainers on said terminal ends of said respective opposite end portions of said rod to prevent the stitches from inadvertently slipping off said rod, said means for detachably interfitting being a resilient yieldable element for extending within and engaging with one of said grooves to detachably secure said end retainers on said respective opposite end portions of said rod.

12. The assembly of claim 11 wherein said end retainers are disc-shaped.

13. The assembly of claim 11 wherein said interfitting means of each of said end retainers includes a plurality of arcuate slots formed in said end retainer, said slots at inner ends being open at a central hole defined through said end retainer and enclosed at outer ends spaced from said central hole, said slots extending radially outward from said inner ends and circumferentially about said central hole to said outer ends such that each of said end retainers is formed with a plurality of resilient arcuate tabs that are engageable with a respective one of said annular grooves to detachably secure said end retainers on said opposite end portions of said rod and that are capable of flexing to allow engagement with and disengagement from said annular groove as a respective one of said opposite end portions of said rod is pushed and pulled into and from said central hole.

14. The assembly of claim 11 wherein said end retainers are made in one-piece of a molded plastic material.

15. The assembly of claim 11 wherein said elongated rod is made from anodized aluminum.

* * * * *